United States Patent [19]

Powers et al.

[11] 4,011,073

[45] Mar. 8, 1977

[54] FLAME SPRAY POWDER OF COBALT-MOLYBDENUM MIXED METAL AGGLOMERATES USING A MOLYBDENUM SALT BINDER AND PROCESS FOR PRODUCING SAME

[75] Inventors: John Allen Powers, New Albany; Martin Benedict MacInnis, Towanda; David John Port, Athens, all of Pa.

[73] Assignee: GTE Sylvania Incorporated, Stamford, Conn.

[22] Filed: July 2, 1975

[21] Appl. No.: 592,476

[52] U.S. Cl. ..... 75/.5 BB; 75/.5 BC; 75/.5 B; 428/404; 428/402; 427/34; 427/423

[51] Int. Cl.[2] ..... C22F 9/00

[58] Field of Search ..... 428/403, 402, 404; 75/.5 B, .5 BA, .5 BB, .5 BC, 211; 29/192 R; 427/34, 423

[56] References Cited

UNITED STATES PATENTS

| | | | |
|---|---|---|---|
| 3,223,523 | 12/1965 | Adler | 75/212 |
| 3,322,515 | 5/1967 | Dittrich et al. | 29/191.2 |
| 3,407,057 | 10/1968 | Timmons | 75/.5 |
| 3,436,248 | 4/1969 | Dittrich et al. | 75/.5 X |
| 3,617,358 | 11/1971 | Dittrich | 75/.5 X |
| 3,907,546 | 9/1975 | Port et al. | 75/.5 BB X |

*Primary Examiner*—Ralph S. Kendall
*Assistant Examiner*—Charles R. Wolfe, Jr.
*Attorney, Agent, or Firm*—Norman J. O'Malley; John C. Fox; Donald R. Castle

[57] ABSTRACT

A flame spray powder of cobalt and molybdenum mixed metal agglomerates is produced by spray drying a slurry of molybdenum metal particles and cobalt oxide particles in an ammonium molybdate solution to produce agglomerates, and thereafter heating the agglomerates in a reducing atmosphere to convert the oxide particles to cobalt metal and the binder to molybdenum metal.

5 Claims, No Drawings

FLAME SPRAY POWDER OF COBALT-MOLYBDENUM MIXED METAL AGGLOMERATES USING A MOLYBDENUM SALT BINDER AND PROCESS FOR PRODUCING SAME

BACKGROUND OF THE INVENTION

This invention relates to flame spray powders of cobalt-molybdenum mixed metal agglomerates and to a method for producing them.

Commonly assigned copending U.S. patent application Ser. No. 414,976, filed Nov. 12, 1973, now abandoned describes free flowing flame spray powders of particle agglomerates held together by an aqueous soluble metallic compound, such as ammonium tungstate or ammonium molybdate, which upon heating to moderate temperatures decomposes to base metal and harmless byproducts. The powders are produced by an agglomerating technique, preferably spray drying.

Such spray drying usually results in a product with wider than desired particle size range, necessitating recycling of out-of-size agglomerates by reslurrying to redissolve the binder and then spray drying again. This ability to recycle out-of-size agglomerates to produce more agglomerates within the desired range of particle size makes such processing economically feasible.

When mixed cobalt-molybdenum agglomerates are prepared, using cobalt and molybdenum or molybdenum alloy metal powders and the ammonium salt of molybdenum as a binder, the binding action is lost upon recycling of the out-sized agglomerates.

SUMMARY OF THE INVENTION

In accordance with the invention it has been found that this loss of binding action (possibly the result of a reaction between the metallic cobalt and the molybdenum salt binder) may be avoided if a non-reactive form of cobalt is substituted for the reactive metallic form, such as cobalt oxide. Following recycling of the out-sized agglomerates, reduction of the nonreactive form of cobalt in the resultant in-sized fractions to the metal results in mixed cobalt-molybdenum metal agglomerate flame spray powder with the desired properties.

Molybdenum may be replaced by a molybdenum alloy in which molybdenum is the greater single constituent.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The starting finely divided material utilized in the formation of the slurry is generally characterized by particle sizes below 20 micrometers, but sometimes below 50 micrometers, and consequent poor flowability. As is known, the flowability (desired for flame spray powder applications) may be improved by agglomeration of these particles to increase their mean particle size.

These particles are mechanically mixed with water containing one or more binders in solution, to form a slurry for spray drying. In accordance with the invention the solution contains ammonium molybdate as an essential constituent. The ammonium molybdate is formed by dissolving molybdenum trioxide in an ammonia-containing solution. For effective binding action to occur, molybdenum trioxide is added in the amount of at least 5 weight percent of the total weight of solids in the spray drying slurry. The spray dried ammonium molybdate is thus present in the spray dried powder in an amount equivalent to about 5 weight percent of molybdenum trioxide based on total weight of powder.

As used herein, the term "spray dried ammonium molybdate" refers to the spray dried product of the ammonium molybdate solution, since normal ammonium molybdate per se is not known to exist in solid form. Upon heating in a reducing atmosphere at around 1000° C, all non-metallic constituents including the spray dried ammonium molybdate are reduced to base metal and harmless byproducts. Such reduction may be achieved by a separate step prior to flame spraying or during flame spraying under reducing conditions.

The non-reactive cobalt compound may be any insoluble compound of cobalt containing oxygen, such as oxides, oxalates and hydroxides.

The particular conditions under which the slurries are formed and spray dried are well known, and are not a necessary part of this description.

Depending upon the application envisioned, the spray dried agglomerates may be classified, usually by screening, in order to obtain the desired particle size distribution, for example within about 60 micrometers and preferably 80% within 30 micrometers for flame spray applications. It has been found that the spray dried powders of the invention normally possess sufficient green strength to withstand handling and classifying. However, it may be desired as optional steps to heat treat the agglomerates either above or below the binder decomposition temperature for purposes such as further strengthening or densification. Of course, such treatments should be carried out under conditions to prevent formation of an unusable mass by substantial diffusion bonding of the agglomerates to one another.

EXAMPLE

This Example used cobalt oxide and molybdenum metal powder with ammonium molybdate as the binder. The feed materials were:

| Material | Weight, Pounds |
|---|---|
| Cobalt Oxide | 100 |
| Molybdenum Metal Powder | 15.4 |
| Molybdenum Trioxide | 15 |
| Ammonium Hydroxide (28%) | 8 |
| Water (4 gallons) | 33.4 |

The molybdenum trioxide was dissolved in the ammonia and diluted with the water to form an aqueous solution of ammonium molybdate. The molybdenum metal powder and cobalt oxide were added to make the slurry. The initial cycle was made up in two equal batches and spray dried. The chamber product (agglomerates) from the two batches were classified, by screening, to remove agglomerates with the particle size range between 200 and 325 mesh. The outsized agglomerates and the cyclone product (fines) from the two batches (52 pounds) were slurried in eight liters of water and again spray dried and classified.

A total of four cycles of spray drying, classifying and reslurrying of out-sized material was made. The agglomerates with a particle size range between 200 and 325 mesh were fired at 900° C for 3½ hours under hydrogen to give the final product.

The following table gives the particle size distribution of the chamber product after the first spray drying and after the fourth.

| Particle Size Range of Agglomerates/Cycle | | First | Fourth |
|---|---|---|---|
| | + 170 mesh,% | 38 | 60 |
| − 170 | + 200 mesh,% | 13 | 16 |
| − 200 | + 270 mesh,% | 15 | 10 |
| − 270 | + 325 mesh,% | 14 | 7 |
| − 325 | | 20 | 12 |

The fact that after four cycles, only 12% of the agglomerates were <325 mesh, is evidence that the binding action of the ammonium molybdate is preserved through recycling when a nonreactive form of cobalt is used.

While there has been shown and described what are at the present considered the preferred embodiments of the present invention it will be obvious to those skilled in the art that various changes and modifications may be made therein without departing from the scope of the invention as defined by the appended claims.

What is claimed is:

1. A flame spray powder consisting essentially of particle agglomerates of finely divided particulates of a metal selected from the group consisting of molybdenum and its alloys, and a compound of cobalt selected from the group consisting of cobalt oxides, cobalt hydroxides and cobalt oxalates, the agglomerates held together by at least one binder consisting essentially of spray dried ammonium molybdate, the spray dried ammonium molybdate being present in an amount equivalent to at least 5 weight percent of molybdenum trioxide based on total weight of powder, whereby upon heating in a reducing atmosphere the spray dried ammonium molybdate and the cobalt compound are reduced to base metal.

2. The flame spray powder of claim 1 wherein the cobalt compound is a cobalt oxide.

3. Process for producing a flame spray powder comprising (a) spary drying a slurry of finely divided particulates of a metal selected from the group consisting of molybdenum and its alloys, and a compound of cobalt selected from the group consisting of cobalt oxides, cobalt hydroxides and cobalt oxalates, in an aqueous solution of a least one binder consisting essentially of ammonium molybdate in an amount equivalent to at least 5 weight percent of molybdenum trioxide based on the total weight of the powder, whereby particle agglomerates of the particulates are formed, held together by the spray dried ammonium molybdate; (b) classifying the agglomerates to obtain agglomerates within a desired particle size distribution; and (c) subjecting agglomerates outside the desired particle size distribution to at least one recycling operation, said recycling comprising reslurrying out-sized agglomerates, spray drying the reslurry to reform agglomerates, and classifying the reformed agglomerates.

4. The process of claim 3 wherein the cobalt compound is a cobalt oxide.

5. The process of claim 3 wherein the spray dried powder is heated in a reducing atmosphere to reduce the spray dried ammonium molybdate and cobalt compound to base metal.

* * * * *